US007726840B2

(12) United States Patent
Pearson et al.

(10) Patent No.: US 7,726,840 B2
(45) Date of Patent: Jun. 1, 2010

(54) MODULAR LED LIGHTING FIXTURES

(75) Inventors: Dennis Pearson, Foothill Ranch, CA (US); Terry Horwitz, Garden Grove, CA (US); Richard Horvath, Mission Viejo, CA (US)

(73) Assignee: Tempo Industries, Inc., Irvine, CA (US)

( * ) Notice: Subject to any disclaimer, the term of this patent is extended or adjusted under 35 U.S.C. 154(b) by 50 days.

(21) Appl. No.: 12/130,882

(22) Filed: May 30, 2008

(65) Prior Publication Data

US 2009/0225546 A1 Sep. 10, 2009

Related U.S. Application Data

(60) Provisional application No. 61/033,654, filed on Mar. 4, 2008.

(51) Int. Cl.
*F21S 4/00* (2006.01)

(52) U.S. Cl. ..... 362/249.06; 362/249.02; 362/249.01; 362/249.03; 362/800; 362/249.09

(58) Field of Classification Search ..... 362/249.02, 362/800, 373, 294
See application file for complete search history.

(56) References Cited

U.S. PATENT DOCUMENTS

| | | | | |
|---|---|---|---|---|
| 5,436,816 | A | 7/1995 | Nagano | |
| 5,559,681 | A * | 9/1996 | Duarte | 362/231 |
| RE36,961 | E | 11/2000 | Nagano | |
| 6,371,637 | B1 * | 4/2002 | Atchinson et al. | 362/555 |
| 6,595,671 | B2 | 7/2003 | Lefebvre et al. | |
| 6,660,735 | B2 * | 12/2003 | Crooks et al. | 514/232.8 |
| 7,329,024 | B2 * | 2/2008 | Lynch et al. | 362/240 |
| 7,399,105 | B2 * | 7/2008 | Southard et al. | 362/391 |
| 7,429,186 | B2 * | 9/2008 | Mrakovich et al. | 439/404 |
| 7,478,925 | B2 * | 1/2009 | Hiyama et al. | 257/E25.02 |
| 7,506,995 | B2 * | 3/2009 | Thomas et al. | 362/227 |
| 7,549,784 | B1 * | 6/2009 | Teeters | 362/576 |
| 2005/0265019 | A1 | 12/2005 | Sommers et al. | |
| 2008/0002399 | A1 | 1/2008 | Villard et al. | |

OTHER PUBLICATIONS

Form PCT/ISA/210 in connection with PCT/US2009/033968 dated Aug. 31, 2009.
Form PCT/ISA/237 in connection with PCT/US2009/033968 dated Aug. 31, 2009.

* cited by examiner

*Primary Examiner*—Anabel M Ton
(74) *Attorney, Agent, or Firm*—Franklin D. Ubell; Greenberg Traurig, LLP

(57) ABSTRACT

Concatenatable lighting fixtures, each comprising a unitary cover member having a circuit board mounting platform integrally formed with suitable heat sinking and which mounts onto a cooperating base chassis. In one embodiment, the circuit board mounting platform extends farther from one end of the cover member than the other so as to facilitate placement of LEDs in a fashion which enhances lighting uniformity and minimizes dark spots. In one embodiment, first and second guide members may be positioned in respective opposite ends of adjacent fixtures, each guide member having a plurality of extending fingers with a flexible electrical conductor-carrying conduit disposed between the respective opposite ends and retained in position by the fingers.

60 Claims, 14 Drawing Sheets

MODULAR LED LIGHTING FIXTURES

This application claims the Paris Convention priority of U.S. Provisional Application No. 61/033,654 entitled "Modular LED Lighting Fixtures," filed Mar. 4, 2008, the contents of which is hereby incorporated by reference in its entirety.

BACKGROUND OF THE INVENTION

1. Field of Invention

This invention relates to the field of lighting technology and more specifically, to the use of LEDs in commercial and residential lighting fixtures.

2. Description of Related Art

Incandescent lighting has a low efficiency since much of the electrical power supplied to such lighting is converted to heat instead of light. The cost of electricity is expected to increase in the future as the cost of producing electricity rises. LEDs (light emitting diodes) provide a much more efficient conversion of electrical energy from incandescent lighting and efforts are underway to employ more efficient and longer lasting LED lamps in various applications.

SUMMARY

Embodiments hereafter disclosed provide a set of interconnected, modular LED lighting fixture components that can be arranged and easily installed in the field in a wide variety of forms and shapes to meet the needs of designers and architects. Various embodiments facilitate low cost, yet attractive designs using LED lighting fixtures suitable, for example, for cove lighting applications and readily installed in the field due to various features. One such feature is a field-installable unitary cover member having a circuit board mounting platform integrally formed with suitable heat sinking and which mounts onto a cooperating base chassis. In one embodiment, the circuit board mounting platform extends farther from one end of the cover member than the other so as to facilitate placement of LEDs in a fashion to maintain relatively uniform spacing of the LED lamps, thereby enhancing lighting uniformity and minimizing dark spots. Various combinations and adaptations of such features in various embodiments facilitate practical use of energy efficient, high power LED lighting technology at modest cost in attractive and easily field installed configurations for architects and designers.

BRIEF DESCRIPTION OF THE DRAWINGS

The foregoing, and other features and advantages, will be apparent from the following, more particular description of the preferred embodiments of the invention made in conjunction with the accompanying drawings of which.

DETAILED DESCRIPTION OF EMBODIMENTS

Figure 1:
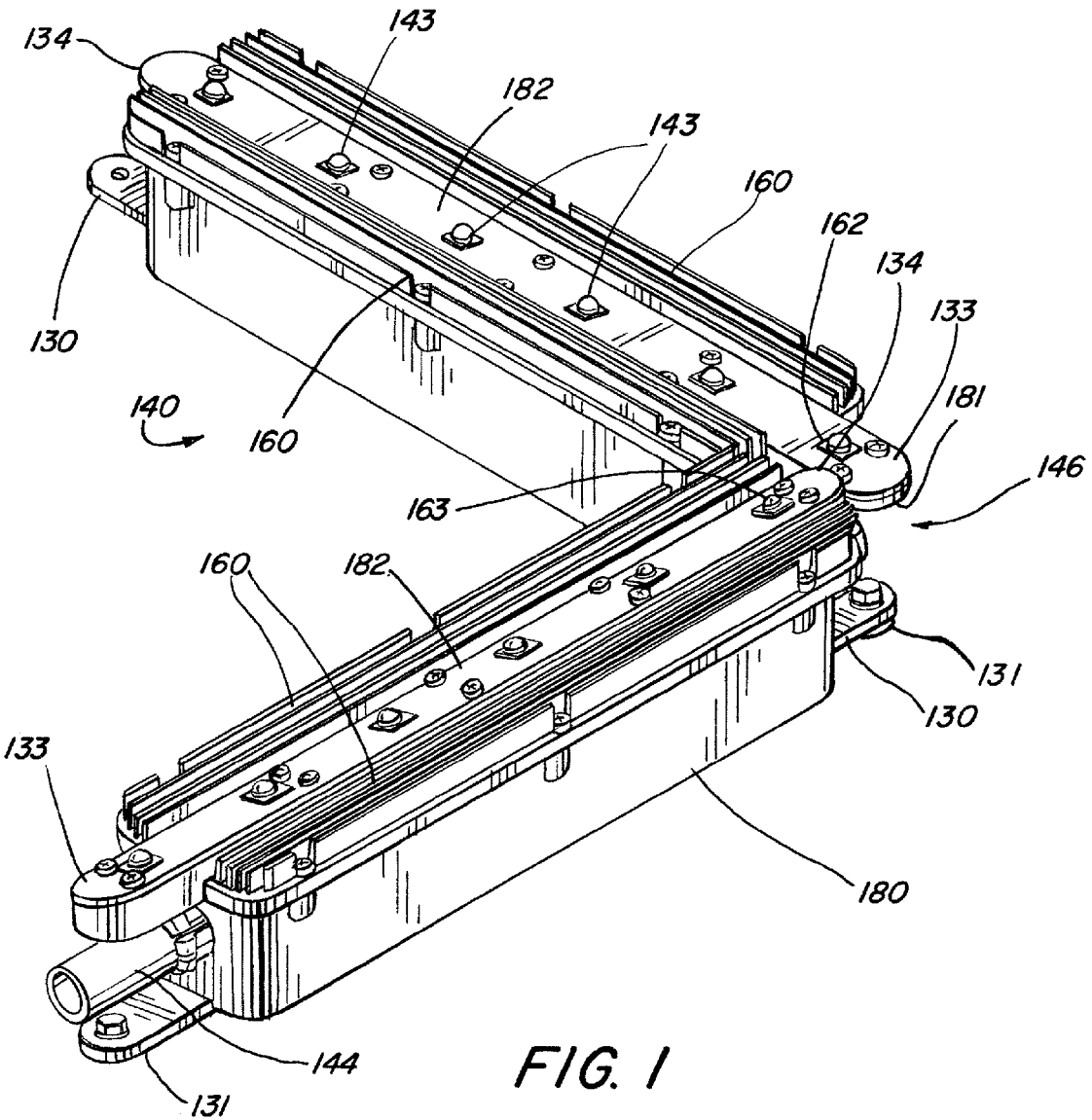
FIG. 1 illustrates a frontal perspective view of two lighting fixture components interconnected together into an assembly.
Figure 2:
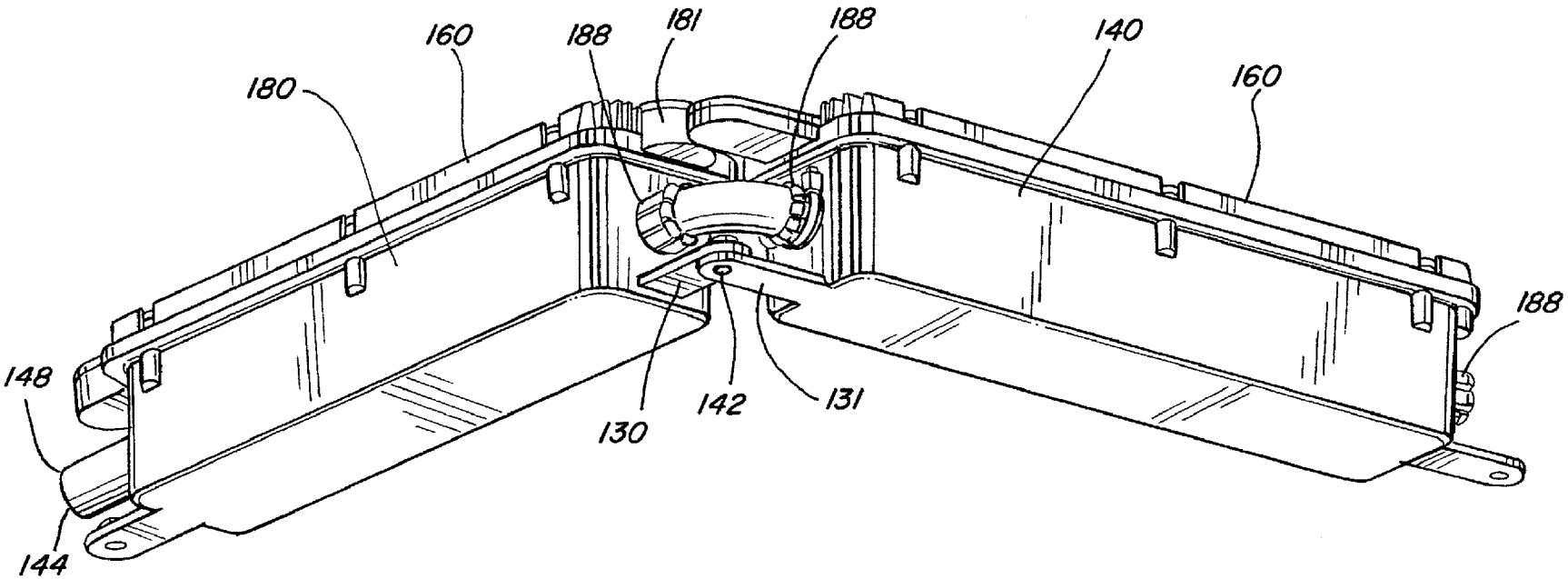
FIG. 2 shows a rear perspective view of the same assembly of two components of FIG. 1.

Further features and advantages, as well as the structure and operation of various embodiments are described in detail below with reference to the accompanying FIGS. 1-8, wherein like reference numerals refer to like elements. The embodiments are described in the context of several component designs with compatible electrical connectors and localized heat sinks. Nonetheless, one of ordinary skill in the art will readily recognize that other embodiments can use different forms and shapes, with different electrical connectors and other features.

FIGS. 1-6 illustrate two generally elongated, box-shaped fixture components 140 and 180 which can be joined at selected arbitrary angles with respect to one another to provide highly configurable LED lighting arrangements. Each fixture component 140, 180, contains a plurality of LED light emitting diodes 143, with suitable heat sinking, e.g. 160. The heat sink component 160, as shown in FIG. 1, for example, is a unitary component bolted or otherwise fastened along its edges to the sides of each component 140, 180. A printed circuit board 182 to which the LEDs 143 are mounted is then attached to the heat sink 160 by suitable screws or other fastening devices or, in other embodiments, a suitable heat transfer adhesive.

Figure 4:
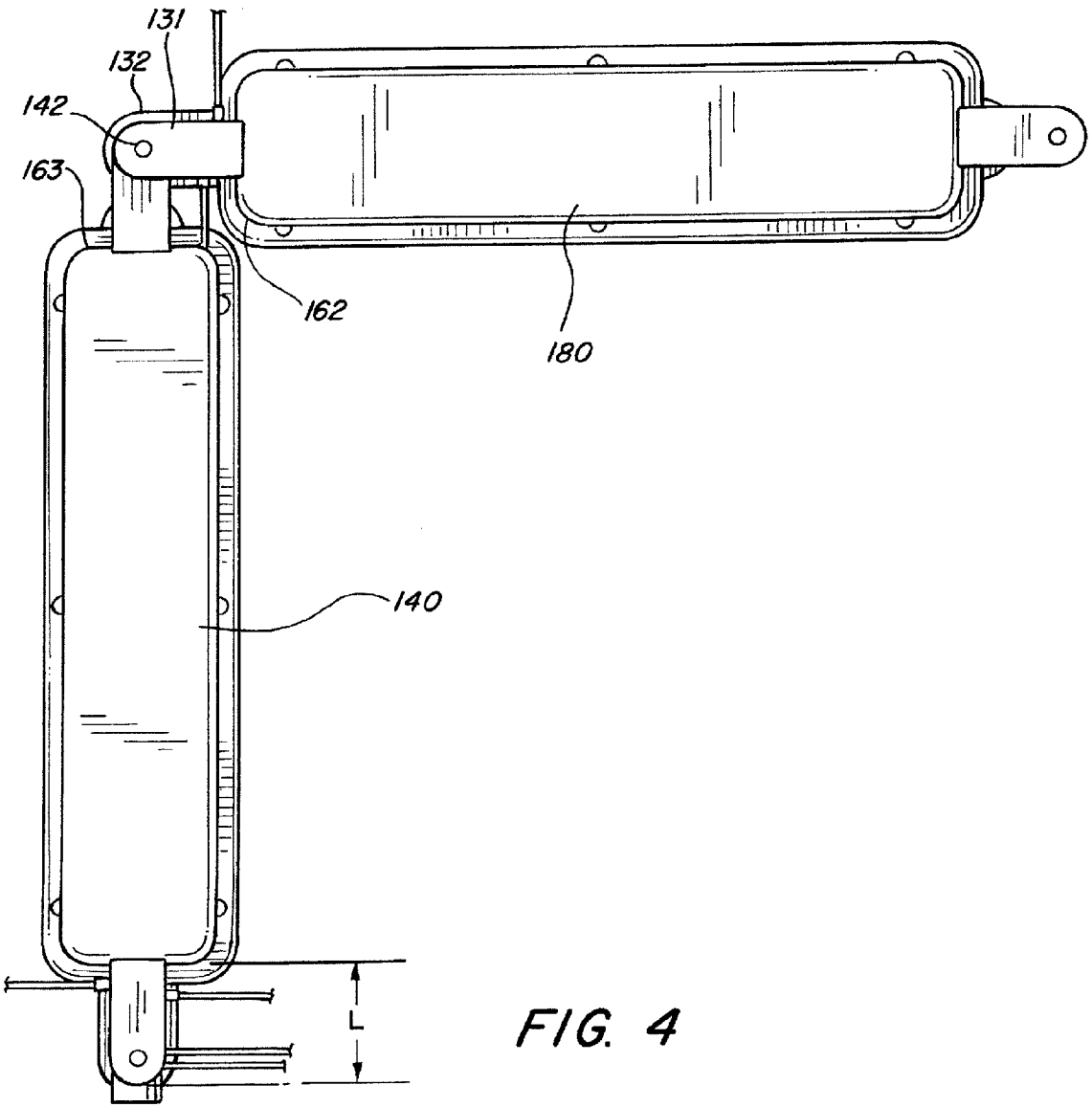
FIG. 4 is a bottom view of the two components of FIG. 1.
Figure 12:
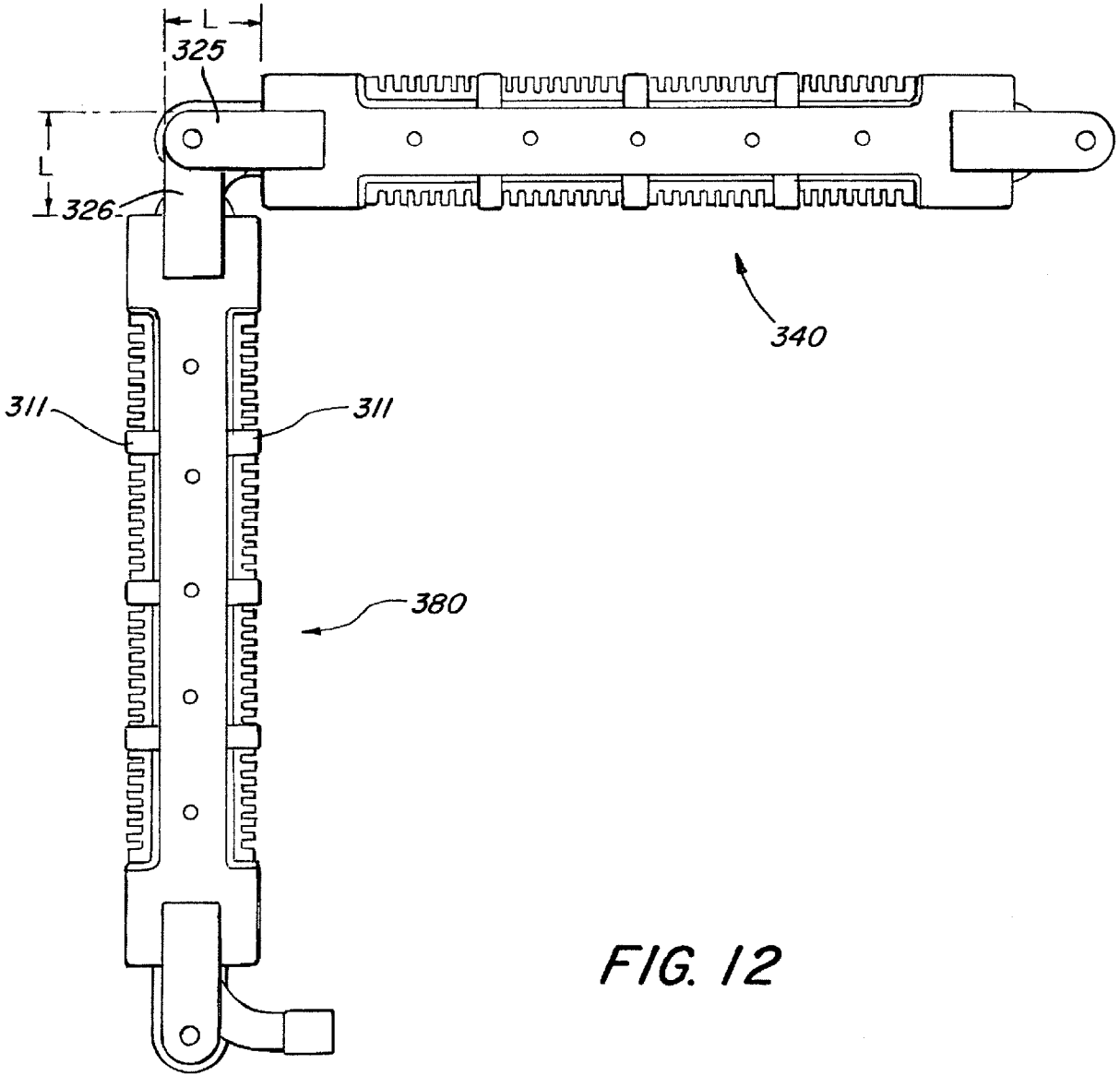
FIG. 12 is a bottom view of the apparatus of FIG. 11.

An elbow joint 146 is formed when the two components 140, 180 are joined by attaching a lower tongue 130 of one component 140 to a lower tongue 131 of the other component 180. As shown in FIGS. 4 and 12, these lower tongues 130, 131 each extend the same length "L" from the respective edges, e.g. 162, 163 of the mating components 140, 180. As may be seen in FIG. 2, the lower tongue 131 of the first fixture component 140 extends so as to underlie the mating lower tongue 130, and these two tongues are attached together by a bolt, screw, or other mechanism 142. Alternatively, a snap-fit pivot interconnection mechanism may be provided to interconnect the two lower tongues 130,131.

Figure 3:
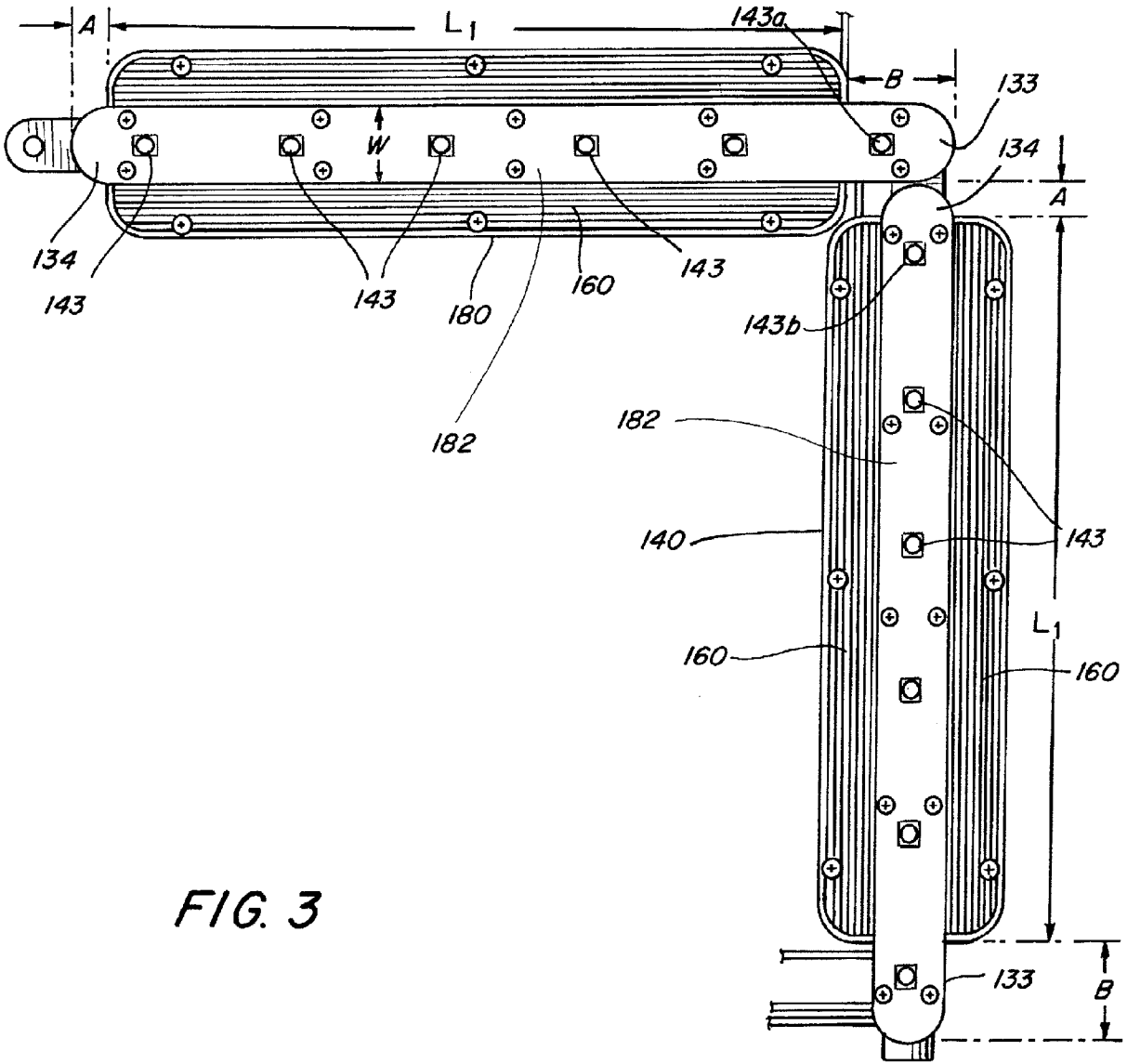
FIG. 3 is a top view of the two components of FIG. 1.
Figure 11:
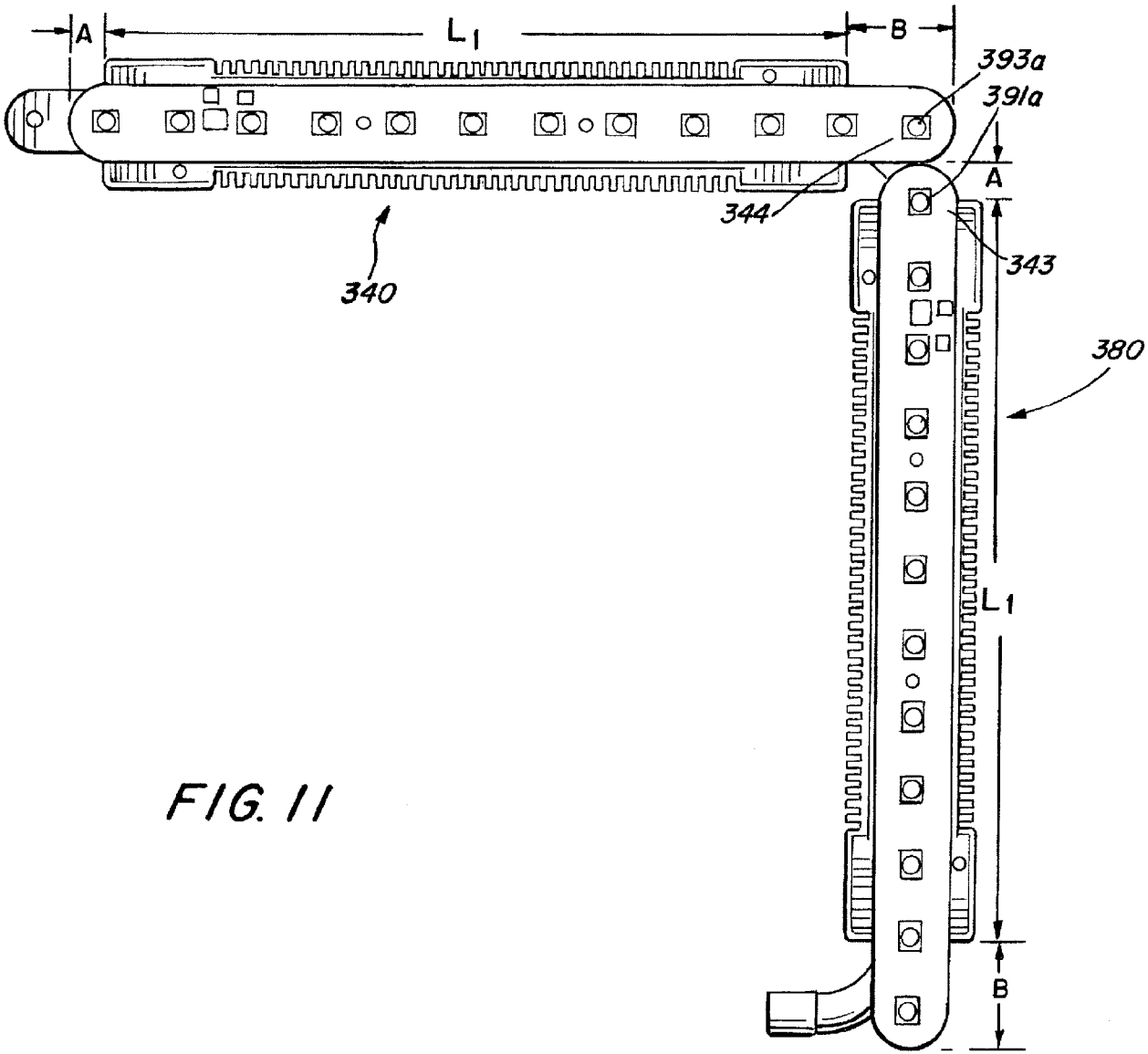
FIG. 11 is a top view of two fixture components according to the embodiment of FIG. 10 joined together.

Each component 140, 180 further has a circuit board mounting platform 181, which extends beyond the length of the box-shaped portion of the component at each end. A circuit board 182, which, in the illustrative embodiment, has the same shape as the platform 181, is mounted on top of the platform 181, and has respective tongues 133, 134 at each end thereof. As illustrated in FIGS. 3 and 11, the extended length "A" of one of the tongues 134 of each circuit board 182 is selected to be equal to half of the width (½"W") of the circuit board 182, while the extended length "B" of the opposite tongue 133 is selected to be equal to one and a half times the width (3/2"W") of the particular circuit board 182. The distance "$L_1$" between the two extended lengths A, B is preferably the same for each of the circuit boards 182. Thus, tongue 134 is shorter than tongue 133. These different lengths allow the two components 140, 180 to be joined at an arbitrary angle with respect to one another of between, for example, −90 degrees and +90 degrees, while still maintaining the LED's of each of the components e.g. LED's 143*a*, 143*b*, spaced close enough together to enhance the uniformity of illumination and to eliminate or considerably reduce the effects of dark spots, or so-called "scalloping". While 90 degree bends are illustrated in the figures, 20 to 30 degree bends are more common in practice. In other embodiments, the extended lengths "A", "B", may be shorter or longer.

To facilitate passage of electrical conductors between the two components 140, 180, the elbow joint 146 includes a non-conductive flexible conduit 144 disposed between them. The conduit 144 provides a hollow tube through which current carrying wires, e.g. 171, 172 supplying a lamp driver unit 170 (FIG. 6) are passed. The conduit 144 passes through and is maintained in position by first and second tubular nonconductive guides 188 and 148 and a tie wrap fastener 271 (e.g. FIG. 2). The conduit 144 may be fabricated using Part No. SM-1216-HY tubing available from Sealcon Co.

Figure 5:
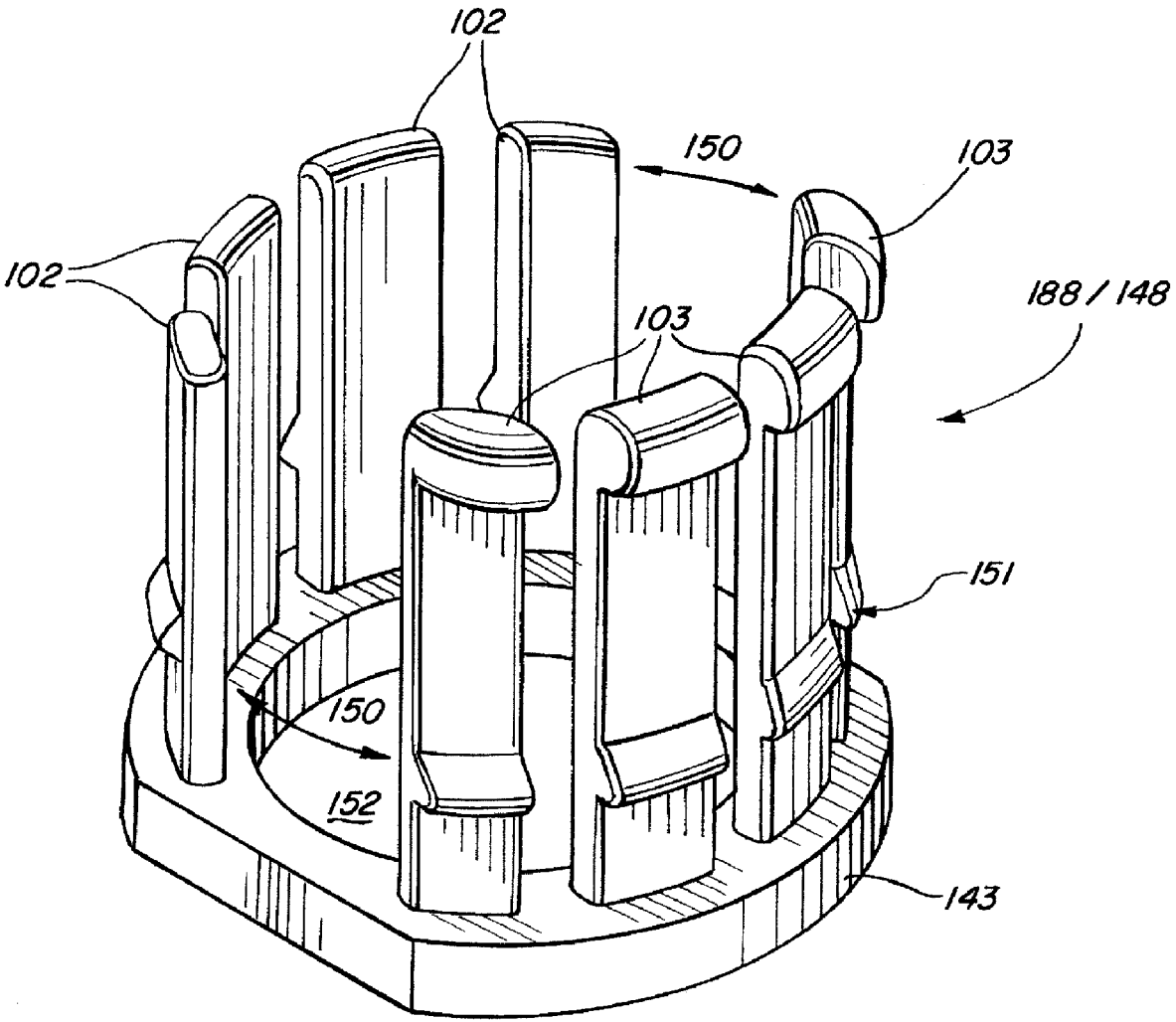
FIG. 5 is a perspective view of an electrical wiring conduit guide.

FIG. 5 illustrates one of the non conductive guides 188, preferably formed of a suitable plastic, which support and guide the electrical wiring conduit 144, allowing the assembly's elbow joint 146 to bend through a range of angles. The conductive guide 188 includes a base 143 having a circular opening 152 therein and from which projects two sets 102, 103 of perpendicularly disposed and radically positioned fingers, which provide a bushing for supporting the conduit 144. There are respective gaps 150 between the sets of fingers 102, 103, which enable them to flex toward one another so as to firmly grasp a conduit section 144 when the tie wrap fastener 271 (e.g. FIG. 2) is applied. Each of the fingers 102, 103 may have a lip or bulbous projection 109 formed on the outer surface of their respective ends 107, 108 to assist in retaining the tie wrap 271 in position. Nubs 145 are also provided on the outer surfaces of each of the fingers 102, 103 to further assist in positioning the tie wrap fastener 271.

Figure 6:
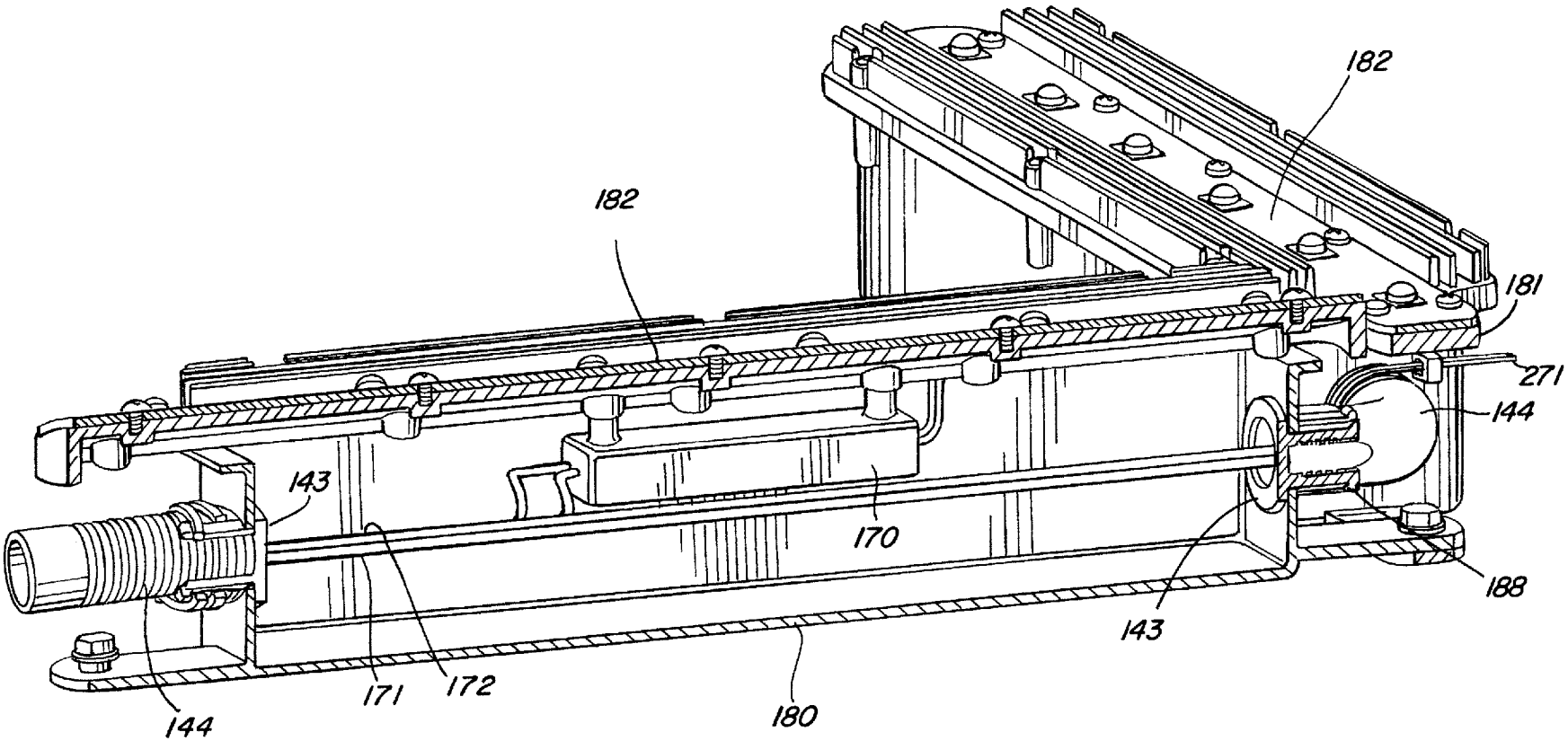
FIG. 6 is a perspective view of the two fixture components of FIG. 1 with one component cut away to illustrate internal features.

As may be seen in FIG. 6, the base 143 of the guide 188 abuts an inner end surface 173 of a fixture component while the fingers 102,103 extend to capture a respective end of the flexible conduit 144, which may then be fastened in place by a tie wrap fastener, e.g. 271.

Figure 7:
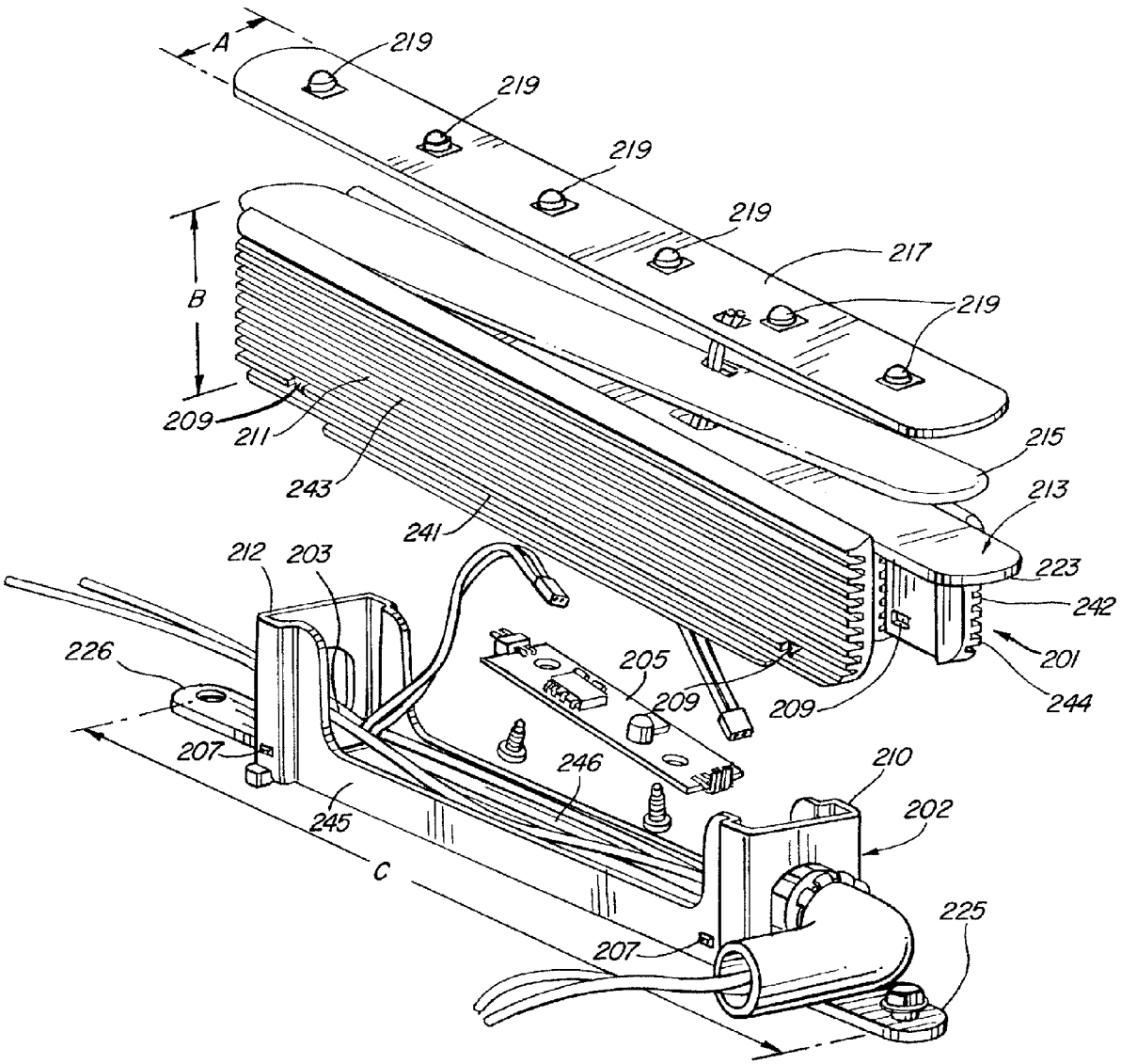
FIG. 7 is an exploded perspective view of an alternate embodiment.

FIG. 7 illustrates another embodiment wherein a unitary cover member 201 is adapted to snap onto a base 202 to form an enclosure for wiring 203 and an LED electrical driver circuit board 205 and attached componentry. The cover member 201 has generally rectangular parallel elongated sides 241, 242, which may be mirror images of one another and which include an array of horizontally veined heat sink fins 243, 244.

The snap-on mechanism may be achieved by providing suitable tabs, tangs, or lips 207 positioned on the side of the base unit 202 so as to mate with apertures 209 in the cover member 201. In such an embodiment, the cover member 201 may exhibit elasticity to flex along its width sufficient to snap over and engage the tangs 207 on the base unit 202, providing the advantage of being able to snap the base 202 and cover 201 together during installation in the field. As shown in FIG. 7, the tabs 207 are formed on respective upwardly projecting end posts 210, 212, which are joined by parallel side rails 245, 246, all integrally formed as part of the preferably unitary base or chassis 202.

Both the base 202 and cover 201 may be formed of die cast aluminum or other suitable metals or composites. The metals may include topical treatments to aid in heat dissipation such as anodizing, paints or other treatments that facilitate heat dissipation. Thermal plastics with metallic based fillers that aid in heat dissipation may be used. A mechanical fastener or fasteners such as screws or a mechanical snap device may also be used to hold the PC board in place onto the heat dissipating cover instead of thermal tape. The thermal tape (such as Berquest, 401 or 3M equivalent) acts to hold the PC board in place without mechanical fasteners and facilitates the transfer of heat to the heat dissipating cover. The alternative use of any coating or topical treatment such as grease, paste or oil that aids in dissipating heat from the PC Board to the heat dissipating base can be used. Illustrative dimensions for a fixture unit as shown in FIG. 7 are circuit board width A'=1 inch, housing height B'=1.5 inches, and base length from one attachment hole center line to the other C'=12 inches or 6 inches.

As may be further seen in FIG. 7, the cover member 201 includes an elongated platform 213, which provides a mounting surface for a conformingly shaped thermal adhesive tape strip 215 and overlying circuit board 217, which carries a serial array of LED's 219. The tape 215 serves to attach the circuit board 217 to the platform 213, while transferring heat from the LED's 219 to the heat sink arrangement 211. Sufficient heat sinking is provided to remove the heat expected to be generated by the LEDs 219 based on their particular power (driving) requirements. Other means of attaching the circuit board 217 may be used, such as for example, rivets or threaded devices such as screws.

The platform 213 of the cover member 201 further has respective radiused tongues 223, 224 at its opposite ends, whose respective lengths differ and are preferably selected as discussed above in connection with the embodiment of FIGS. 1-6 so as to facilitate the positioning of LEDs 219 in adjacent, interconnected units so as to enhance the uniformity of illumination and avoid dark spots. Similarly, lower tongues 225, 226 extend from the base member and are dimensioned so as to facilitate attachment to adjacent units, also as discussed above.

Figure 8:
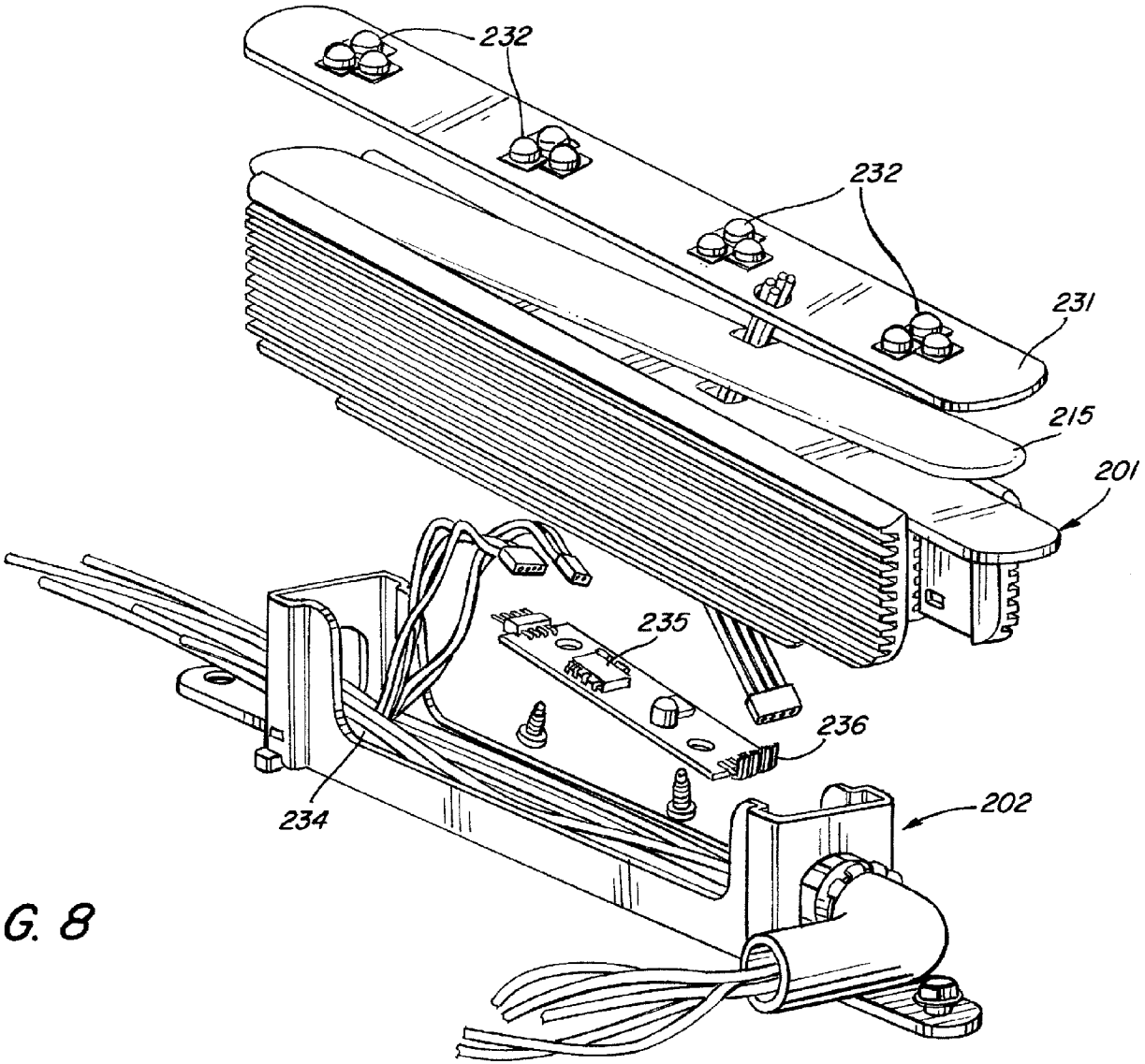
FIG. 8 is an exploded perspective view of a second alternate embodiment.

FIG. 8 illustrates an embodiment similar to that of FIG. 7. One particular difference is that the circuit board 231 of FIG. 8 carries an array of groups 232 of three LED's. Each group includes a red, green and blue LED, thus facilitating generation of various colors of light. A suitable electrical conductor arrangement 234 is additionally provided to supply current to the respective LED drivers circuitry, e.g. 235, located on internally positioned driver circuit board 236.

Figure 9:
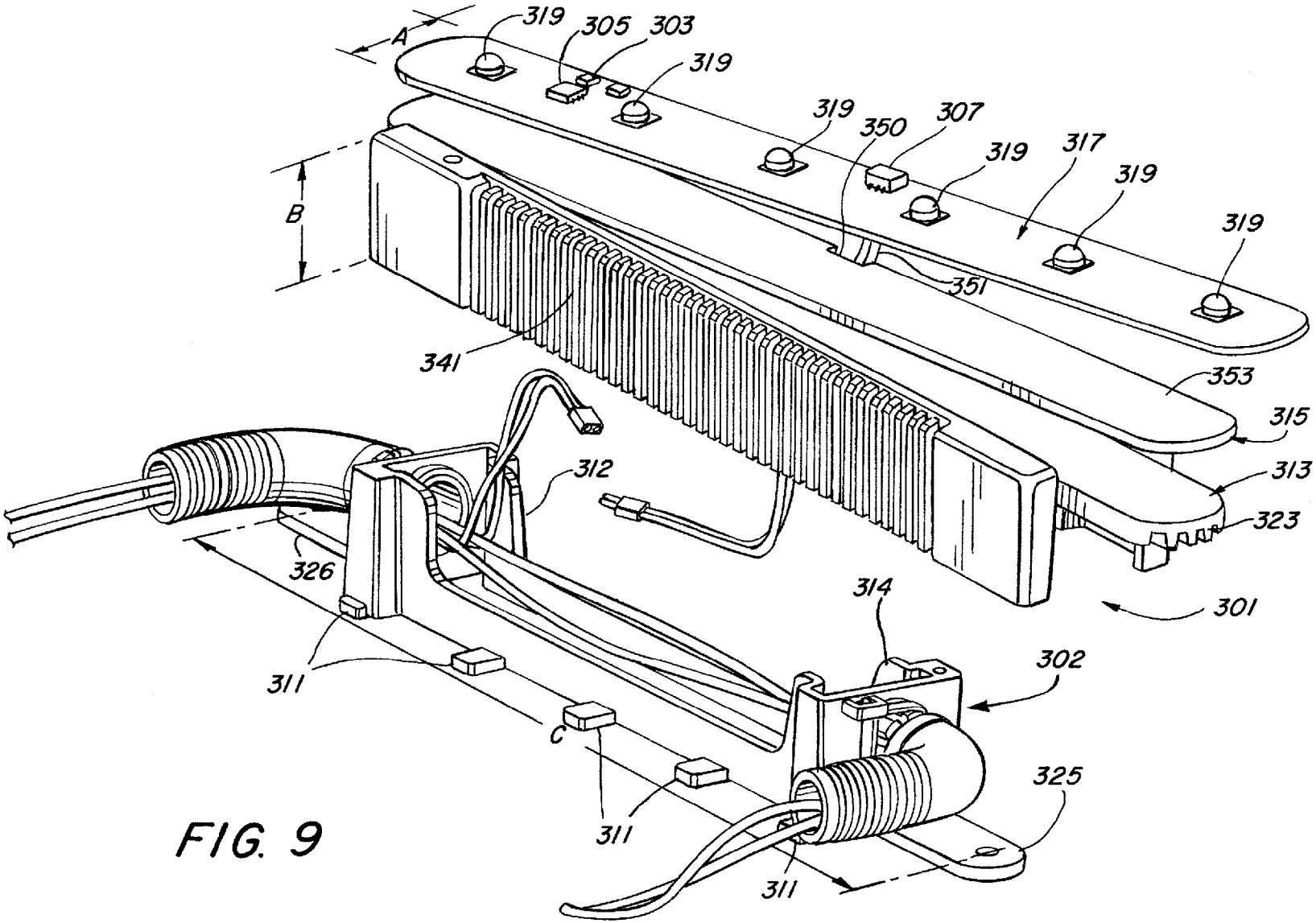
FIG. 9 is an exploded perspective view of a third alternate embodiment.

FIG. 9 illustrates a fixture component embodiment similar to that of FIG. 7 but with some differences. In particular, the heat sink fins e.g. 341, are disposed vertically on either side of the cover member 301, and the driver circuitry e.g. 303, 307 for the LEDs 319 is disposed on the top LED-carrying surface of the PC board 317. The PC board 317 may be fabricated of aluminum to further assist in heat transfer. Finally, the base or chassis, 302 has horizontally disposed feet 311 projecting perpendicularly from the side rail 345 and posts 314 on each side of the unit. In an illustrative embodiment, such feet may be ¼" long each and extend ⅛" from the edge of the overhanging cover member 301. These feet 311 serve to maintain proper spacing from the side of a cove wherein the fixture components, e.g. 301, may be mounted to facilitate downward installation of the cover member onto and over the chassis 302 by installers in the field and to contribute, in various applications, to better light uniformity, elimination of so-called "hot spots", and improved thermal convection and heat dissipation. In some embodiments, holes could be provided in the feet to facilitate attachment of the unit in upright or inverted positions.

Figure 13:
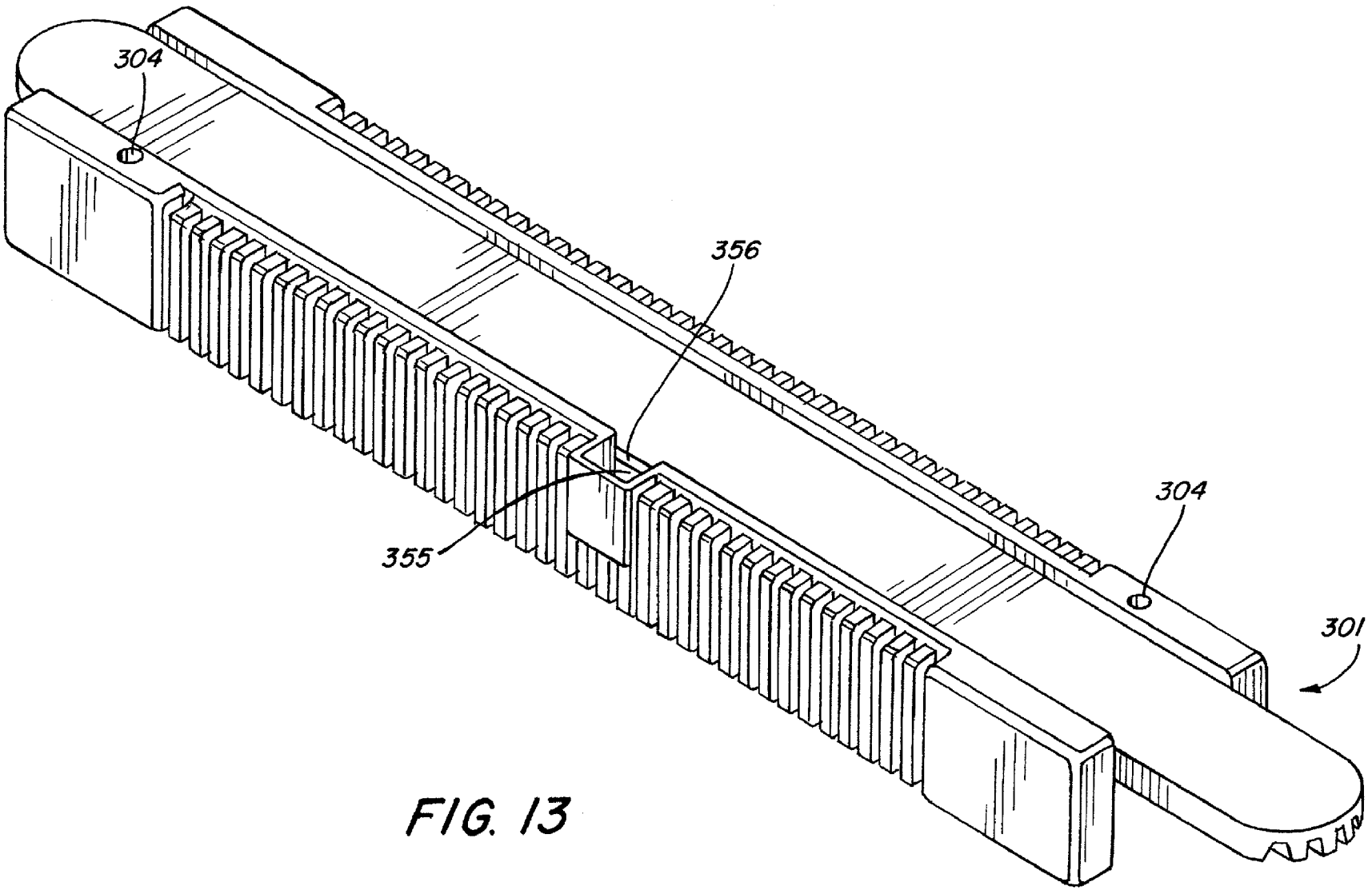
FIG. 13 is a perspective view of a cover component of the embodiment of FIG. 10.

Additionally, in the embodiment of FIG. 9, the cover member 301 is attached to the chassis 302 by bolts, screws or other suitable mechanically fasteners (not shown) inserted for example, through holes 304 (FIG. 13) rather than by a snap-fit mechanism. In one embodiment, the cover 301 itself may be slightly tapered in inside cross-section such that it is slightly narrower at the bottom (dimension "D") than at the top.

Additionally, in FIG. 9, the aperture 350 in the circuit board 315 and cooperating aperture 355 in the cover 301 for introducing electrical leads 351 may be located at an outer edge 353, 356 (FIG. 13) of the respective components 315, 301 rather than the center (e.g. FIG. 7) or other position so as to enable the circuit board to be assembled first prior to attachment of the electrical connections and to simplify cutting of the circuit board out of aluminum. Thus, the electrical wiring may curve up and over the edge of the PC board, such that it is not necessary to provide a notch or other opening in the PC board.

Figure 10:
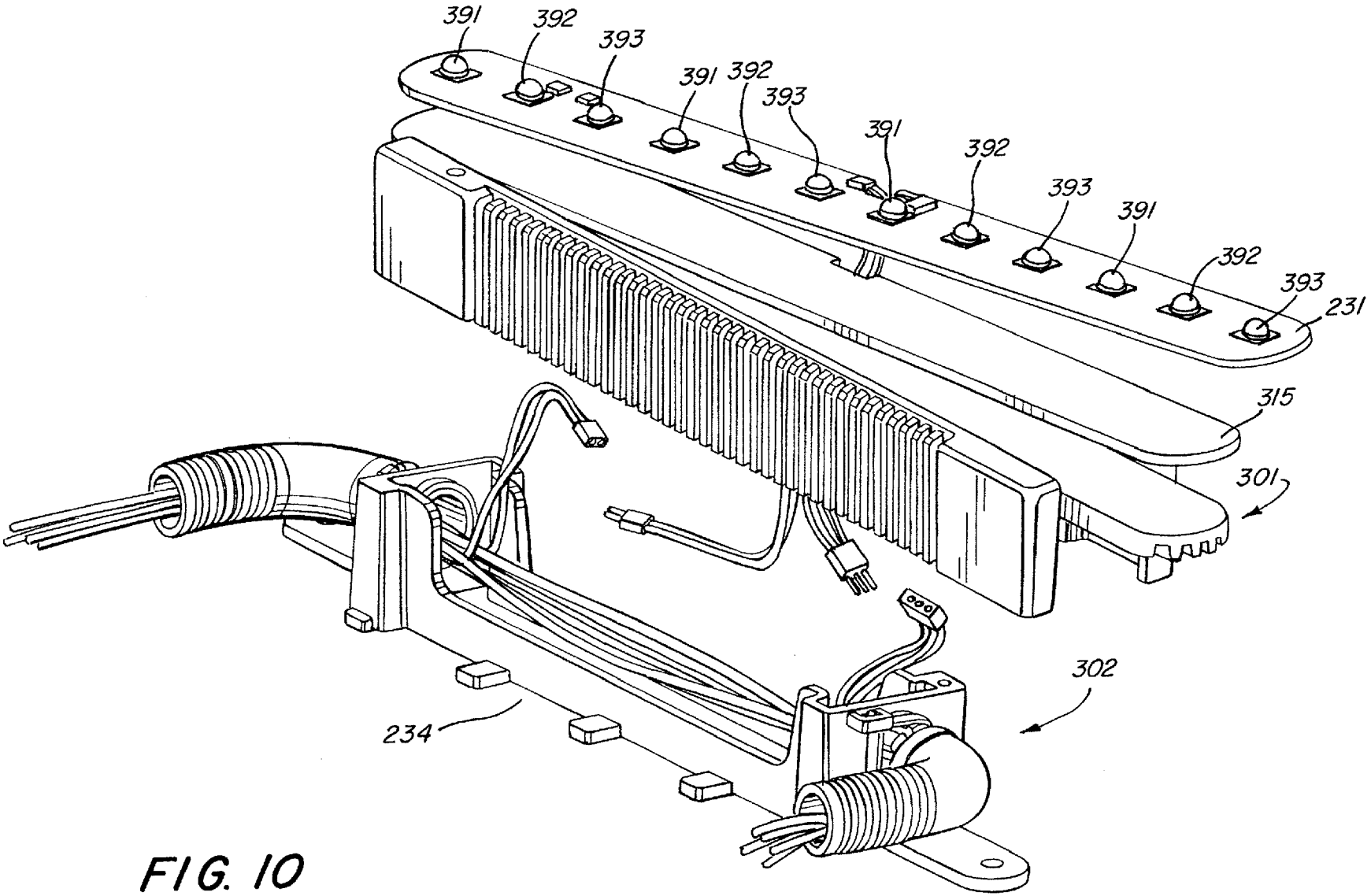
FIG. 10 is an exploded perspective view of a fourth alternate fixture component embodiment.

FIG. 10-12 illustrate an alternative embodiment similar to that of FIG. 9 with the exception that red, green, and blue LEDs 391, 392, 393, respectively, are employed with suitable electrical conductors and driving circuitry. As shown in FIG. 11, the A, B dimensioning of opposed tongues used in connection with the embodiment of FIGS. 1-6 is utilized to more closely position the end-most LEDs 393*a*, 391*a* of adjacent fixtures 340, 380.

Various modifications may of course be made to the above disclosed embodiments in various other embodiments. For example, the plurality of LED light emitting diodes 143 is could be directly mounted on a heat sink in one embodiment. In another embodiment, the plurality of LED light emitting diodes 143 is mounted on a series of interchangeable circuit boards. A plurality of interchangeable circuit boards offers various power ratings and brightness ratings, and each fixture has an associated heat exchange requirement for various application settings and designs.

The heat sink 160, in one embodiment, has a fixed heat exchange capability in ambient air. Other embodiments may provide a range of heat sink size choices so that higher power and lower power LED light emitting diodes can be substituted to customize the design to the environment in which the components will be applied.

Various embodiments can prove advantageous in cove lighting applications where they can be concatenated and arranged to traverse various circuitous paths. In one embodiment, an oval design can be configured by choosing the proper component types and quantities to complete the oval shape as specified in particular lighting design requirements. Various embodiments may further include the advantageous wire harness interconnection and/or retention apparatus disclosed in U.S. provisional patent application Ser. No. 61/033,346, filed Mar. 3, 2008, now U.S. Utility application Ser. No. 12/130,882 incorporated in its entirety by reference herein.

Figure 14:
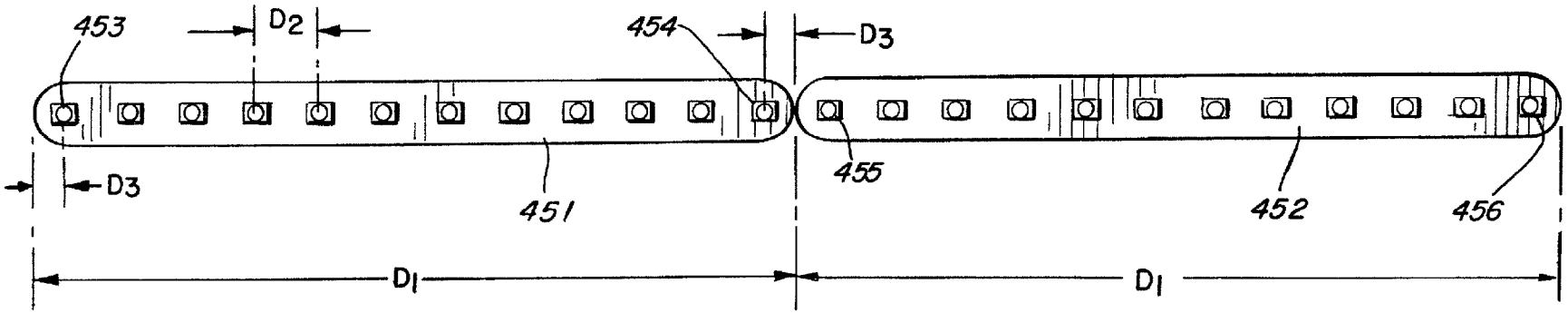
FIGS. 14 and 15 are schematic diagrams illustrating LED lamp placement according to two respective illustrative embodiments.
Figure 15:
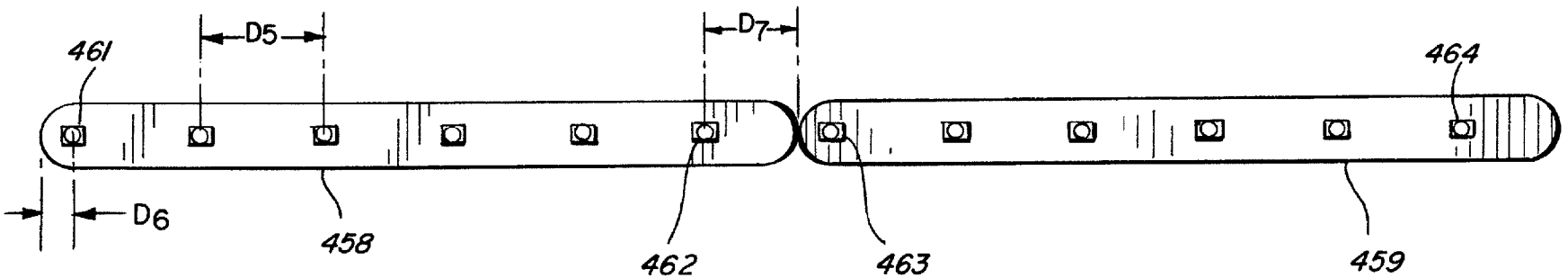

FIGS. 14 and 15 illustrate useful LED spacings which may be implemented in various embodiments. FIG. 14 illustrates two adjacent 12" ("$D_1$") PC boards 451, 452, each carrying 12 LED lamps equally spaced a distance $D_2$ of one inch apart from one another. The end-most LED's 453, 454, 455, 456 are each spaced a distance e.g. $D_3$ of ½ inch from the adjacent end of the respective board 451, 452 such that the opposite end-most lamps 454, 455 on adjacent boards 451,452 lie one inch apart, thus maintaining a one inch spacing across interconnected lamp fixture components.

FIG. 15 illustrates a layout of LED lamps spaced a distance $D_5$ of two inches apart on adjacent 12 inch boards 458, 459. Each board 458, 459 carries six LED lamps. The end-most lamps 461, 463 at the left end of each board 458, 459 is mounted a distance $D_6$ of ½ inch from that end, while the end-most lamps 462, 464 at the right-most ends are mounted a distance $D_7$ of 1.5 inches from those ends, thus resulting in the desired two inch spacing between the opposite end-most lamps 462, 463.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. Apparatus comprising:

a first fixture component and a second fixture component;

a first tongue extending from the first fixture component and having a length;

a second tongue extending from the second fixture component and having a length, the first and second tongues being dimensioned to overlap one another to facilitate interconnection of said first and second components;

a first mounting surface on said first component having parallel edges and terminating in a third tongue having a length;

a second mounting surface on said second component having parallel edges and terminating in a fourth tongue having a length;

first and second circuit boards positioned above said first and second mounting surfaces respectively, said first and second circuit boards each carrying a plurality of LEDs; and the length of said third tongue being selected to be longer than the length of said fourth tongue so as to enable said first and second fixture components to be mounted at any one of a selected range of angles with respect to one another while positioning said LEDs so as to enhance uniformity of illumination provided thereby.

2. The apparatus of claim 1 further comprising:

first and second guide members positioned in respective opposite ends of said first and second components, each guide member having a plurality of extending fingers; and a flexible conduit disposed between said respective opposite ends and retained in position by said fingers.

3. The apparatus of claim 1 wherein said first and second fixture components each comprises a unitary cover and an underlying base unit, the unitary cover member adapted to mount onto the underlying base unit.

4. The apparatus of claim 3 wherein said cover member includes an array of heat sink fins.

5. The apparatus of claim 4 wherein said first mounting surface is formed as part of the unitary cover member of said first fixture component and said second mounting surface is formed as part of the unitary cover member of said second fixture component.

6. The apparatus of claim 5 wherein said first tongue is formed as part of the base unit of said first fixture component and said second tongue is formed as part of the base unit of said second fixture component.

7. The apparatus of claim 3 wherein the underlying base unit has a plurality of feet horizontally extending therefrom.

8. The apparatus of claim 1 wherein said first and second circuit boards are attached to said first and second mounting surfaces by thermally conductive tape.

9. The apparatus of claim 6 wherein said cover member has an aperture at an outer edge of said mounting surface providing a passageway for one or more electrical conductors.

10. Light fixture apparatus comprising:

a unitary cover member having first and second ends and an elongated platform located on an exterior top surface of said cover member, said platform providing a mounting surface;

first and second tongues extending from opposite ends of said elongated platform and beyond the respective first and second ends of said cover member, a circuit board having a top surface carrying an array of LEDs and a bottom surface positioned above said mounting surface, respective ends of said circuit board lying above said first and second tongues; and the length of said first and second tongues being different and selected to assist in disposing said LEDs so as to enhance the uniformity of illumination provided thereby.

11. The apparatus fixture of claim 10 further comprising a unitary base member having first and second vertical support members extending upwardly therefrom, said unitary cover member shaped and dimensioned to fit down and over said support members so as to form an enclosure wherein electrical leads are disposed.

12. The apparatus of claim 11 wherein said cover member snap-fittingly engages said base member.

13. The apparatus of claim 11 wherein said cover member is fastened to said base member by one or more mechanical fastening devices.

14. The apparatus of claim 10 wherein one of the tongues has a length ½W and the other tongue has a length ⅜W where "W" is a width of said circuit board.

15. Apparatus comprising:

a first lighting fixture component having a top surface and first and second downwardly depending side surfaces, the top and side surfaces enclosing electrical leads passing through an interior of said first fixture component;

a second lighting fixture component having a top surface and first and second downwardly depending side surfaces, the top and side surfaces enclosing electrical leads passing through an interior of said second lighting fixture component;

a first tongue extending from a first end of the first lighting fixture component and having a length;

a second tongue extending from a second end of the second lighting fixture component disposed opposite the first end of said first lighting fixture component and having a length, the first and second tongues being dimensioned to overlap one another, said first and second tongues being pivotally connected together such that said first lighting fixture component may pivot with respect to said second lighting fixture component;

a first mounting surface located on the top surface of said first lighting fixture component, the first mounting surface terminating in a third tongue having a length;

a second mounting surface located on the top surface of said second lighting fixture component, the second mounting surface terminating in a fourth tongue having a length;

a first plurality of LEDs each mounted spaced apart from the other above and along a length of said first mounting surface;

a second plurality of LEDs each mounted spaced apart from the other above and along a length of said second mounting surface; and the length of said third tongue being selected to be longer than the length of said fourth tongue such that said LEDs are positioned to achieve enhanced uniformity of illumination when said first and second lighting fixture components are pivotally interconnected at any one of a selected range of angles with respect to one another.

16. The apparatus of claim 15 further comprising:

a flexible conduit disposed between the first end of said first lighting fixture component and the first end of said second lighting fixture component, the flexible conduit conducting electrical leads between said first lighting fixture component and the second lighting fixture component.

17. The apparatus of claim 15 wherein said first and second lighting fixture components each comprises a unitary cover member adapted to mount onto an underlying base unit.

18. The apparatus of claim 17 wherein the unitary cover members of each of said first and second lighting fixture component includes an array of heat sink fins.

19. The apparatus of claim 18 wherein said first mounting surface is formed as part of the unitary cover member of said first lighting fixture component and said second mounting surface is formed as part of the unitary cover member of said second lighting fixture component.

20. The apparatus of claim 19 wherein said first tongue is formed as part of the base unit of said first lighting fixture component and said second tongue is formed as part of the base unit of said second lighting fixture component.

21. The apparatus of claim 17 wherein the underlying base unit has a plurality of feet horizontally extending from a side thereof.

22. The apparatus of claim 15 wherein said first and second plurality of LEDs are mounted on first and second circuit boards respectively attached to said first and second mounting surfaces.

23. The apparatus of claim 17 wherein said first and second plurality of LEDs are mounted on first and second circuit boards respectively attached to said first and second mounting surfaces.

24. The apparatus of claim 17 wherein each unitary cover member has an aperture at an outer edge of said mounting surface providing a passageway for one or more electrical conductors.

25. Light fixture apparatus comprising:

a unitary elongated, generally box-shaped cover member having opposite ends;

an elongated platform on an exterior top surface of said cover member, said platform comprising an elongated mounting surface above which are mounted a plurality of LEDs; and said elongated platform having first and second tongues, each tongue extending beyond a respective one of the opposite ends of said cover member, at least one of the tongues having an LED disposed above its top surface, the length of said first and second tongues being different and selected to position said LEDs so as to enhance the uniformity of illumination provided thereby.

26. The light fixture apparatus of claim 25 further comprising a unitary base member having first and second vertical support members extending upwardly therefrom, said unitary cover member fitting down and over said support members to form an enclosure, a plurality of electrical leads being positioned in said enclosure.

27. The light fixture apparatus of claim 26 wherein said cover member snap-fittingly engages said base member.

28. The light fixture apparatus of claim 26 wherein said cover member is fastened to said base member by one or more mechanical fastening devices.

29. The light fixture apparatus of claim 1 wherein one of the tongues has a length ½W and the other tongue has a length ⅜W where "W" is a width of said circuit board.

30. The light fixture apparatus of claim 25 wherein one of the tongues has a length ½W and the other tongue has a length ⅜W where "W" is a width of said mounting surface.

31. Apparatus comprising:

a first lighting fixture component carrying a first plurality of LEDs;

a second lighting fixture component carrying a second plurality of LEDs;

a first tongue extending from a lower end of the first fixture component and having a length;

a second tongue extending from a lower end of the second fixture component and having a length, the first and second tongues being positioned and dimensioned to overlap one another to facilitate interconnection of said first and second fixture components;

a first mounting surface on a top side of said first fixture component terminating in a third tongue having a length;

a second mounting surface on a top side of said second fixture component terminating in a fourth tongue having a length;

first and second circuit boards positioned above said first and second mounting surfaces respectively, said first and second circuit boards respectively mounting said first and second plurality of LEDs; and the length of said third tongue being selected to be longer than the length of said fourth tongue so as to enable said first and second fixture components to be mounted at any one of a selected range of angles with respect to one another while positioning said LEDs so as to enhance uniformity of illumination provided thereby.

32. Lighting fixture apparatus comprising:

a single piece cover member having a horizontally disposed mounting platform;

said single piece cover member further having respective first and second side surfaces depending downwardly on opposite sides of said platform, said first and second side surfaces each further including a heat sink structure; and wherein the mounting platform is recessed beneath respective top edges of said first and second side surfaces and has first and second ends, each of the first and second ends extending beyond a respective end of said cover member.

33. The lighting fixture apparatus of claim 32 further comprising:

a single piece base member having first and second elongated side rails and first and second upwardly extending end posts at respective opposite ends of said first and second elongated side rails, wherein the unitary base member is shaped and dimensioned such that said unitary cover member is installable downwardly over said mounting posts to form an enclosure for electrical componentry of said fixture.

34. The lighting fixture apparatus of claim 33 further including a plurality of horizontally projecting feet disposed along a bottom edge of said base member and shaped and dimensioned to space the lighting fixture apparatus a selected distance from a surface adjacent thereto.

35. The lighting fixture apparatus of claim 34 further including one or more holes in a top surface of said cover member and one or more fastening devices insertable through said one or more holes to removably fasten said cover member to said base member.

36. The lighting fixture apparatus of claim 33 further including an aluminum circuit board carrying a plurality of LEDs and mounted on said platform within said recess.

37. The apparatus of claim 36 wherein one of the tongues has a length ½W and the other tongue has a length ⅜W where "W" is a width of said circuit board.

38. The lighting fixture apparatus of claim 37 wherein said circuit board mounts 12 LED lamps equally spaced apart from one another with a first of the end-most LEDs spaced ½ inch from a first end of the circuit board and the opposite end-most LED spaced ½ inch from a second end of the circuit board.

39. The lighting fixture apparatus of claim 37 wherein said circuit board mounts 6 LEDs each spaced two inches from the other with one end-most LED being spaced ½ inch from one end of the circuit board and the opposite end-most LED being spaced 1½ inches from the opposite end of the circuit board.

40. Lighting fixture apparatus comprising:

a single piece cover member having a first mounting platform and respective first and second side surfaces depending downwardly on opposite sides of said first platform, said first and second side surfaces each further including a heat sink structure;

wherein the first platform has first and second ends, each extending beyond a respective end of said cover member;

a plurality of LEDs positioned above said first mounting platform; and a unitary base member having first and second elongated side rails and first and second upwardly extending end posts at respective opposite ends of said first and second elongated side rails;

wherein the unitary base member is shaped and dimensioned such that said unitary cover member is installable downwardly over said mounting posts and attachable to said mounting posts to form an enclosure for electrical componentry of said apparatus.

41. The lighting fixture apparatus of claim 40 further including a plurality of horizontally projecting feet disposed along a bottom edge of said base member and shaped and dimensioned to space the lighting fixture apparatus a selected distance from a surface adjacent thereto.

42. The lighting fixture apparatus of claim 40 further including one or more holes in a top surface of said cover member and one or more fastening devices insertable through said one or more holes to removably fasten said cover member to said base member.

43. The lighting fixture apparatus of claim 40 further including a circuit board carrying a plurality of LEDs and mounted on said mounting platform.

44. The apparatus of claim 43 wherein one of the tongues has a length ½W and the other tongue has a length ⅜W where "W" is a width of said circuit board.

45. The lighting fixture apparatus of claim 43 wherein said circuit board mounts 12 LED lamps equally spaced apart from one another with a first the end-most LEDs spaced ½ inch from a first end of the circuit board and the opposite end most LED spaced ½ inch from a second end of the circuit board.

46. The lighting fixture apparatus of claim 43 wherein said circuit board mounts 6 LEDs each spaced two inches from the other with one end-most LED being spaced ½ inch from one end of the circuit board and the opposite end-most LED being spaced 1½ inches from the opposite end of the circuit board.

47. The lighting fixture apparatus of claim 40 wherein said platform has a horizontal planar surface recessed below adjacent portions of a top surface of said cover member.

48. The lighting fixture apparatus of claim 40 further comprising:

a first tongue extending from said unitary base member; and a second single piece cover member having a second mounting platform and respective first and second side surfaces depending downwardly on opposite sides of said second platform, said first and second side surfaces of said second cover member each further including a heat sink structure;

wherein the second platform of said second cover member has first and second ends, each extending beyond a respective end of said second cover member;

a plurality of LEDs positioned above the second mounting platform of said second cover member; and a second unitary base member having first and second elongated side rails, first and second upwardly extending end posts at respective opposite ends of said first and second elongated side rails and a second tongue extending therefrom and dimensioned to overlap said first tongue, said first and second tongues being pivotally interconnectable;

wherein the second unitary base member is shaped and dimensioned such that said second unitary cover member is installable downwardly over the mounting posts of said second cover member and attachable to said mounting posts to form an enclosure for electrical componentry of said apparatus.

49. The lighting fixture apparatus of claim 48 wherein the length of one of the tongues of said first cover member is selected to be longer than the length of an oppositely disposed tongue of said second cover member so as to position said LEDs to achieve uniformity of illumination when said first and second lighting fixture components are pivotally interconnected to one another.

50. The lighting fixture apparatus of claim 49 wherein the heat sink structure on each of said first and second side surfaces comprises a plurality of heat sink fins.

51. Lighting fixture apparatus comprising:

a single piece cover member having a mounting platform and respective first and second side surfaces depending downwardly on opposite sides of said platform;

a plurality of LEDs positioned above said mounting platform; and a unitary base member having first and second elongated side rails and first and second upwardly extending end posts at respective opposite ends of said first and second elongated side rails;

wherein the unitary based member is shaped and dimensioned such that said unitary cover member is installable downwardly over said end posts.

52. Apparatus comprising:

a first fixture component and a second fixture component;

a first tongue extending from the first fixture component and having a length;

a second tongue extending from the second fixture component and having a length, the first and second tongues being dimensioned to overlap one another to facilitate pivotal interconnection of said first and second components;

a first mounting surface on said first component terminating in a third tongue having a length;

a second mounting surface on said second component;

first and second circuit boards positioned above said first and second mounting surfaces respectively, said first and second circuit boards each carrying a plurality of LEDs; and means formed at opposing ends of each of said first and second mounting surfaces for enabling spacing said LEDs so as to maintain uniformity of illumination when said first and second fixture components are pivotally interconnected to one another.

53. A method for constructing lighting fixture apparatus comprising:

fabricating first and second light fixtures each having an elongated mounting surface positioned on a top surface thereof; and dimensioning the length of respective first and second ends of said first and second mounting surfaces to enable spacing LEDs positioned on said first and second mounting surfaces so as to enhance the uniformity of illumination provided by the LEDs.

54. The method of claim 53 further comprising:

spacing a plurality of LEDs the same selected distance apart on each respective first and second mounting surface; and dimensioning the length of opposing ends of said first and second mounting surfaces so as to enable spacing an end most LED on one opposing end of said first mounting surface said same selected distance from an end-most LED on the opposing end of said second mounting surface.

55. The method of claim 54 wherein said step of fabricating comprises forming first and second unitary covers comprising the respective mounting surfaces of the first and second light fixtures.

56. The method of claim 55 wherein said first and second cover members are formed of die cast aluminum.

57. The apparatus of claim 1 further comprising:

a plurality of LEDs spaced the same selected distance apart on each respective first and second mounting surface; and wherein opposing tongues of said first and second mounting surfaces are dimensioned so as to enable spacing an end most LED on one opposing end of said first mounting surface said selected distance from an end-most LED on the opposing end of said second mounting surface.

58. The apparatus of claim 15 further comprising:

a plurality of LEDs spaced the same selected distance apart on each respective first and second mounting surface; and wherein opposing tongues of said first and second mounting surfaces are dimensioned so as to enable spacing an end most LED on one opposing end of said first mounting surface said selected distance from an end-most LED on the opposing end of said second mounting surface.

59. The apparatus of claim 31 further comprising:

a plurality of LEDs spaced the same selected distance apart on each respective first and second mounting surface; and wherein opposing tongues of said first and second mounting surfaces are dimensioned so as to enable spacing an end most LED on one opposing end of said first mounting surface said selected distance from an end-most LED on the opposing end of said second mounting surface.

60. The lighting fixture apparatus of claim 48 further comprising:

a plurality of LEDs spaced the same selected distance apart on each respective first and second mounting platform; and wherein opposing ends of said first and second mounting platforms are dimensioned so as to enable spacing an end most LED on one opposing end of said first mounting surface said selected distance from an end-most LED on the opposing end of said second mounting surface.

* * * * *